US006328285B1

(12) United States Patent
Wiseman

(10) Patent No.: US 6,328,285 B1
(45) Date of Patent: Dec. 11, 2001

(54) RAIL APPARATUS

(75) Inventor: Richard R. Wiseman, Townville, SC (US)

(73) Assignee: Charron Sports Services, Inc., Liberty, SC (US)

( * ) Notice: Subject to any disclaimer, the term of this patent is extended or adjusted under 35 U.S.C. 154(b) by 0 days.

(21) Appl. No.: 09/400,218

(22) Filed: Sep. 21, 1999

(51) Int. Cl.[7] ..... E04H 17/14
(52) U.S. Cl. ..... 256/59; 256/67
(58) Field of Search ..... 256/89, 65–67, 256/DIG. 2, DIG. 6, 19, 32, 47; 52/8, 9; 248/158

(56) References Cited

U.S. PATENT DOCUMENTS

| | | | | |
|---|---|---|---|---|
| 1,297,838 | * | 3/1919 | Haines | 256/32 |
| 3,119,588 | * | 1/1964 | Keats | 256/1 X |
| 3,599,924 | * | 8/1971 | Schmidgall | 248/158 |
| 3,788,608 | | 1/1974 | Raymond et al. | 256/59 |
| 3,964,215 | | 6/1976 | Hatman et al. | 52/9 |
| 4,006,564 | | 2/1977 | Wiese | 52/9 |
| 4,014,522 | | 3/1977 | Sutter | 256/59 |
| 4,014,523 | | 3/1977 | Reader | 256/59 |
| 4,361,991 | | 12/1982 | Wiese | 52/9 |
| 4,571,895 | | 2/1986 | Lymann, Jr. | 52/9 |
| 4,718,624 | * | 1/1988 | Greulich | 248/158 |
| 4,997,165 | | 3/1991 | Wiese | 256/59 |
| 5,402,988 | * | 4/1995 | Eisele | 256/19 X |
| 5,560,588 | * | 10/1996 | Hilliard | 256/65 |
| 5,586,423 | * | 12/1996 | Mullen | 256/65 X |
| 5,813,663 | | 9/1998 | Victor et al. | 256/59 |
| 5,820,110 | | 10/1998 | Beu | 256/59 |
| 6,015,139 | * | 1/2000 | Weber | 256/65 |
| 6,038,829 | * | 3/2000 | Franks | 256/65 X |

* cited by examiner

*Primary Examiner*—Harry C. Kim
(74) *Attorney, Agent, or Firm*—John B. Hardaway, III; Hardaway/Mann IP Group

(57) ABSTRACT

A rail apparatus that is attachable to a support surface such as a set of telescoping bleachers and is capable of remaining attached when the support structure is in either an extended, open position or a retracted, closed position. The rail apparatus has a P-shaped handle portion integral with a shaft element that is connected to the support surface through a mounting system having a support socket and spring system. The mounting system is connected to the support surface either on the front, top or side thereof. The spring system is inside the lower portion of the shaft and provides a force that keeps the handle portion of the rail apparatus in place within the support socket, yet allows for the handle portion to be rotated to various other positions if desired. When the position of the rail apparatus is changed, the spring system is compressed, the rail apparatus moved and the spring system is then decompressed and allowed to once again apply pressure and keep the rail apparatus in the selected position within the support socket. The mounting system allows for the rail apparatus to remain connected to the support surface when it is in either an open, extended position or a closed, retracted position. The rail apparatus also has a rear support attachment that can be attached to the underneath side of the support surface as well as the support socket to provide added support and stability to the rail apparatus.

11 Claims, 10 Drawing Sheets

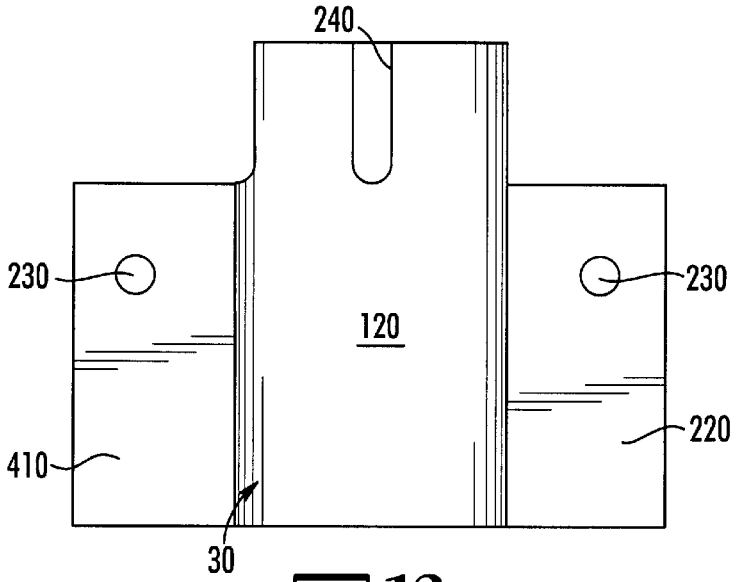
FIG. 12
FIG. 13
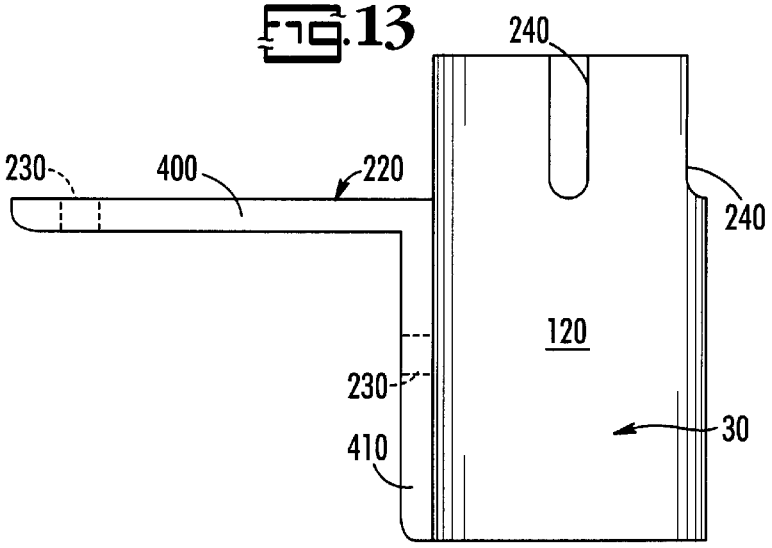
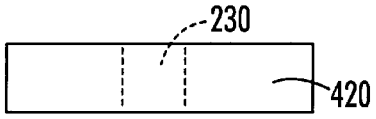
FIG. 14

RAIL APPARATUS

BACKGROUND OF THE INVENTION

1. Field of Invention

The present invention relates to a rail apparatus and more specifically to a rail apparatus that is attachable to a support surface such as a set of telescoping bleachers and is capable of being rotated to various positions and remaining attached to the support surface when the support surface is in either an extended, open position or a retracted, closed position.

2. Description of Prior Art

It is important, on various types of support structures from retractable bleachers in school gymnasiums to concrete outdoor steps, to provide hand rails or supports to aid people ascending and descending the support structure.

Traditionally, hand rails have been bolted directly to the support structures and are permanently attached in one position. Examples of these types of rails may be found in U.S. Pat. Nos. 3,964,215, 4,571,895, 4,014,522 and 4,014,523.

When the rails are permanently attached in one position, they either prevent collapsible support surfaces such as bleachers from being retracted into a closed position or they must be removed before closing the support surface.

One solution to this problem has been rail systems that incorporate an attachment system that allows the rail to be easily removed and stored in a separate location when the support structure is in a stored position. U.S. Pat. No. 5,813,663 exemplifies this solution.

Another solution to the problem present in collapsible bleacher systems that have rails is shown in U.S. Pat. Nos. 4,997,165, 4,006,564, 4,361,991, and 3,788,608 which all provide systems that allow the rails to swivel partially and either lay flat, lean at an angle from or abut against the bleacher system when it is in a retracted or closed position. However, all of these systems require the rail to be located at an outer edge of the support surface. None of the patented inventions allow for the rails to be located within the interior of the collapsible bleacher systems.

And yet, another example of a rail system that allows for the rails to be rotated from one position to another while still being attached to the support surface is that found in U.S. Pat. No. 5,820,110. This system also limits the rails to being located at the outer edges of the support surface and would not operate properly if it were relocated to the interior portion of the support surface.

It is therefore desirable to have a rail apparatus that is permanently attached to a collapsible support system and is rotatable so as to allow the handle portion of the rail apparatus to move between various positions and would allow for the support structure to be placed in a storage position without removing the rail apparatus. Such a rail apparatus would also be capable of being placed within the interior of the support surface, not just at the edges, so as to provide support to users ascending and descending the support structure in the middle thereof.

While the above stated devices are a fair representation of the current prior art, there remains room for improvement as defined by the currently claimed invention.

SUMMARY OF THE INVENTION

An objective of the present invention is to provide a rail apparatus that is capable of remaining in place on a retractable support structure, such as bleachers, when the support structure is in either an extended, open position as well as in a retracted, closed position.

Another object of the present invention is to provide a rail apparatus that can be moved to various positions, adding versatility to the rail apparatus while maintaining its ability to function properly.

Yet another object of the present invention is to provide a rail apparatus with various support attachments that add stability and strength to the rail apparatus.

Still another object of the present invention is to provide a strong, supported rail apparatus that is versatile enough to be attached to the front, top or sides of a support structure as well as to a flat surface.

The aforementioned objectives will be accomplished by the rail apparatus that is attachable to a support surface having a P-shaped handle portion integral with a shaft element that extends down and is connected to the support surface or bleachers through a mounting system having a support socket and spring system. The support socket and spring system are connected to the support surface or bleachers either on the front, top or side of the support surface. The spring system is inside the lower portion of the shaft and provides a force that keeps the handle portion of the rail apparatus in place within the support socket, yet allows for the handle portion to be rotated to various other positions if desired. When the position of the rail apparatus is changed, the spring system is compressed, the rail apparatus moved and the spring system is then decompressed and allowed to once again apply pressure and keep the rail apparatus in the selected position within the support socket. The rail apparatus also has a rear support attachment that can be attached to the underneath side of the support surface as well as the support socket to provide added support and stability to the rail apparatus.

Other features and advantages of the present invention will become more apparent from the following detailed description. The description of the present invention discloses, in conjunction with the drawings which illustrate by way of example, the principles and objects of the invention.

BRIEF DESCRIPTION OF THE DRAWINGS

The features of the present invention will become apparent to those skilled in the art to which the present invention relates from the following specification with reference to the accompanying drawings in which:

FIG. 12 is a front elevation view of a second embodiment of the support socket;

FIG. 13 is a side elevation view of the second embodiment of the support socket;

FIG. 14 is a side elevation view of a rear plate of the second embodiment of the support socket;

DETAILED DESCRIPTION OF THE INVENTION

Figure 1:
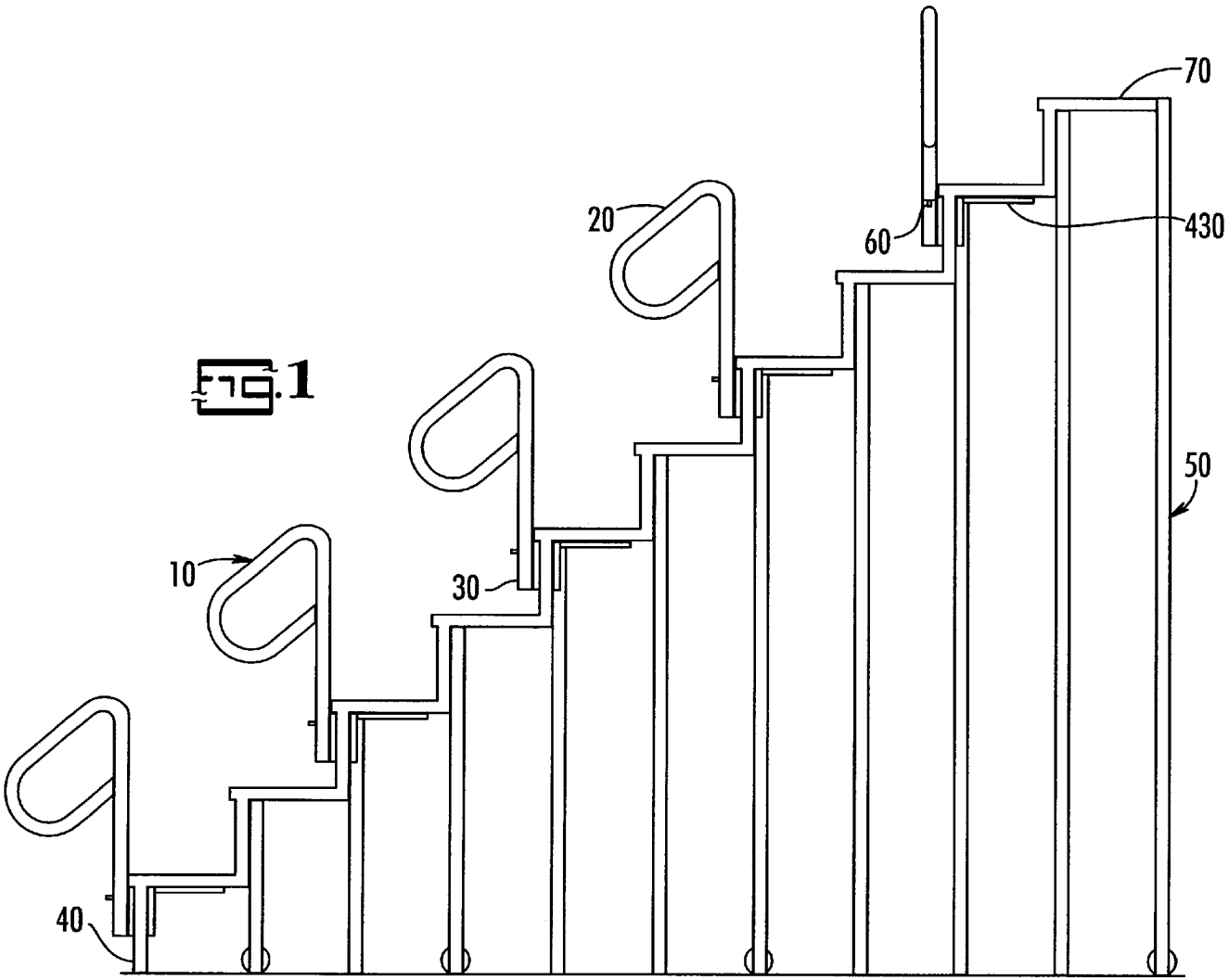
FIG. 1 is a side elevation view of a set of telescoping bleachers 50 in an extended position with a plurality of rail apparatuses in position for use, with the top rail apparatus in a position for storage.

FIG. 1 is a side elevation view of a support structure 50, such as a set of telescoping bleachers, in an extended position with a plurality of rail apparatuses 10 in position for use, with the top rail apparatus 10 in a position for storage. The rail apparatus 10 is attached to any type of support structure 50, preferably telescoping bleachers, which are capable of being pulled into an extended open position as shown in FIG. 1 as well as being retracted into a closed or layered fashion when not in use. A rear support attachment 430 is connected to the back or underneath side of the support structure 50 and opposite the support socket 30 of the rail apparatus 10 providing support therefore. The rail apparatus 10 is versatile enough to be attachable to either the rise portion 40 of the support structure 50 or the run portion 70. The preferred embodiment, as shown, of the rail apparatus 10 is attached to the rise portion 40 or front of the support structure 50 and therefore allows for the support structure 50 to be either in an open, extended position or in a closed, retracted position without disrupting or removing the rail apparatus 10. In FIG. 1, the top rail apparatus 10 has been rotated from extending in a forwardly direction to a side direction, illustrating the position the rail apparatus 10 should be placed in when the support structure 50 is going to be retracted into a closed position for storage. Each rail apparatus 10 is comprised of a handle portion 20, a support socket 30 and a pin 60 or lynch peg 100, to be discussed in greater detail later. A plurality of rail apparatuses 10 can be attached or connected to a support structure 50, such as collapsible bleachers, as needed. That is, the total number of rail apparatuses 10 required on any given support structure 50 is discretionary and may vary according to need. It is possible to use one for a single step or several for a complete bleacher system.

Figure 2:
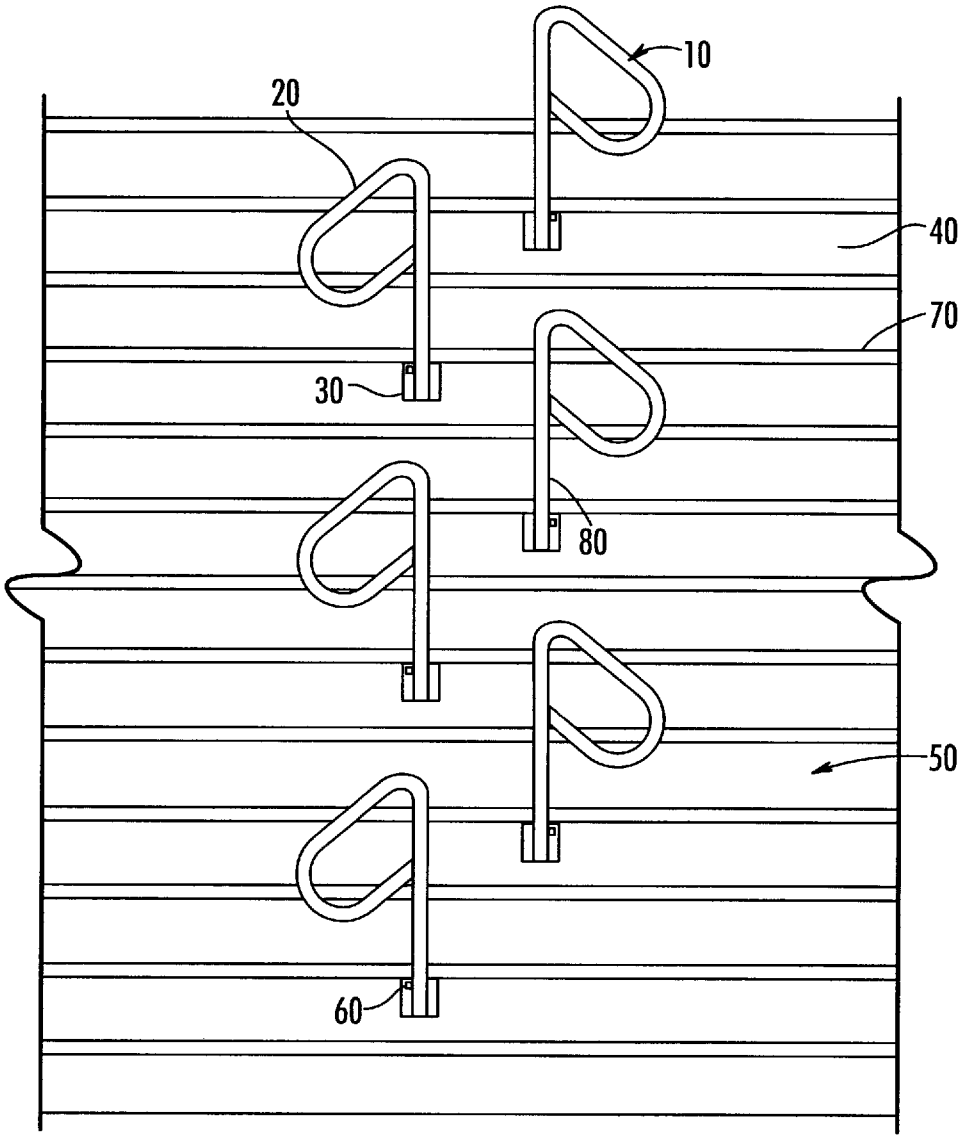
FIG. 2 is a front elevation view of a set of telescoping bleachers in a retracted or closed position with a plurality of rail apparatuses in position for storage.

FIG. 2 is a front elevation view of a support structure 50, such as telescoping bleachers, in a retracted or closed position with a plurality of rail apparatuses 10 in position for storage. In this figure, each rail apparatus 10 has been rotated and set in a position wherein the "p" loop or handle portion 20 is parallel with the support structure 50. That allows the handle portion 20 of the rail apparatus 10 to extend complimentary to and close to or next to the support structure 50 itself. This unobtrusive arrangement allows for the rail apparatuses 10 to remain connected to the support structure 50 while they are placed in a storage position. Hence, a separate storage area for the rail apparatuses 10 is eliminated as well as the hassle and effort required to constantly attach and detach the rail apparatuses 10 before and after every use of the support structure 50.

The rail apparatus 10 can be arranged on the support structure 50 or bleachers in any desirable fashion. The present embodiment shows each rail apparatus 10 even spaced from the other rail apparatuses 10 in the same area. Each rail apparatus 10 can be rotated a complete 360 degree turn if desired until being locked into a specific position as defined by the pin or peg channel 240 as will be discussed at a later point. If the rail apparatuses 10 are closely aligned, it may be necessary to offset the rotation of every other handle portion 20 so that the rail apparatuses 10 do not overlap and prevent the support structure 50 from being placed in a completely closed position. FIG. 2 shows the handle portion 20 of every other rail apparatus 10 placed facing the opposite direction as the handle portion 20 of the each rail apparatus 10 immediately preceding and immediately following it. This allows for each handle portion 20 on each rail apparatus 10 to lie in an unobstructed position near the support structure 50 and also parallel therewith. If each rail apparatus 10 is spaced far enough apart from its surrounding rail apparatuses 10, or they are not necessarily placed in a linear pattern but are randomly placed or they are placed in some different pattern that would allow enough room between neighboring rail apparatuses 10, then it is possible each handle portion 20 could be rotated in the same direction so that each handle portion 20 is facing the same position as the other rail apparatuses 10, instead of being placed in a position offset from the other surrounding rail apparatuses 10.

Each rail apparatus 10 is comprised of a handle portion 20 in the upper portion of the rail apparatus 10, and the handle portion 20 includes a shaft 80. The shaft 80 is connected or attached to a support socket 30 in such a manner that the handle portion 20 protrudes upward from the support socket 30. The support socket 30 is attached to a support structure 50, such as a set of bleachers. A pin 60 (or lynch peg 100 shown in FIG. 4) is connected to the lower part of the shaft 80 and is used to help secure or lock in the rail apparatus 10 into the desired position within the support socket 30.

Figure 3:
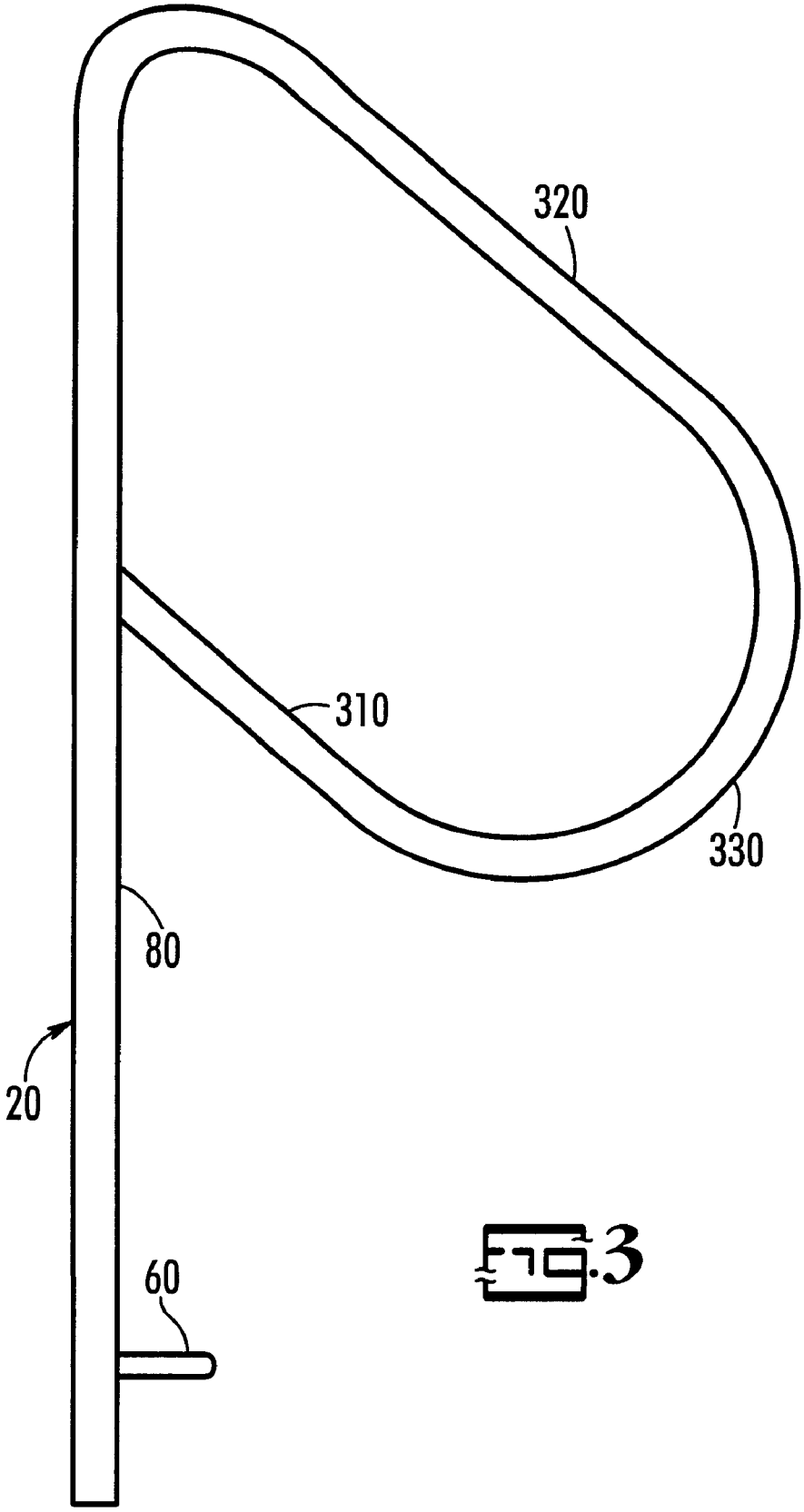
FIG. 3 is a side elevation view of the handle portion of a first embodiment of a P-shaped rail apparatus.

FIG. 3 is a side elevation view of the handle portion 20 of a first embodiment of a rail apparatus 10. The rail apparatus 10 is referred to as "P-shaped" due to the handle portion 20 resembling a "P" having an upper hand support 320 and a lower hand support 310. This upper and lower hand support 320,310 arrangement allows for people of varying heights to use the rail apparatus 10 for support and aid when ascending and descending the bleachers 50 or stairs. The nose support 330 or front part of the "P" is also useful in providing a support surface to people ascending the support structure 50 or bleachers. As a person moves up the support structure 50, they can grab the nose support 330 portion of the handle 20 of the next rail apparatus 10 and support themselves or pull themselves up as they ascend to the next level of the support structure 50. While the preferred embodiment of the rail apparatus 10 is "P-shaped", various other shaped handle portions 20 are acceptable and may be used.

The upper hand support 320 and the lower hand support 310 are both connected at one end, or integrally formed, with a shaft 80 that extends somewhat parallel to the nose support 330. Together the upper portion of the shaft 80, the upper and lower hand supports 310,320 and the nose support 330 form a closed loop. In the preferred embodiment, the upper and lower hand supports 310,320 extend out and down from the shaft 80 at an angle. Such angle may vary, depending upon preference and can even be at 90 degrees, causing the upper and lower hand supports 310,320 to be perpendicular to the shaft 80.

At the opposite end of the shaft 80 than the upper and lower hand supports 310,320 is the spring mechanism 300 (not shown in FIG. 3 and will be described in detail in reference to FIG. 5) that forms part of the attachment means for the rail apparatus 10 to be attached to the support structure 50. In this preferred embodiment of the rail apparatus 10, a pin 60 is attached to and extends out from the lower portion of the shaft 80. The pin 60 is used by placing it in a pin channel 240 (FIG. 8) so as to help keep the rail apparatus 10 in position within the support socket 30 (FIG. 8) and prevent it from moving or rotating unnecessarily.

Figure 4:
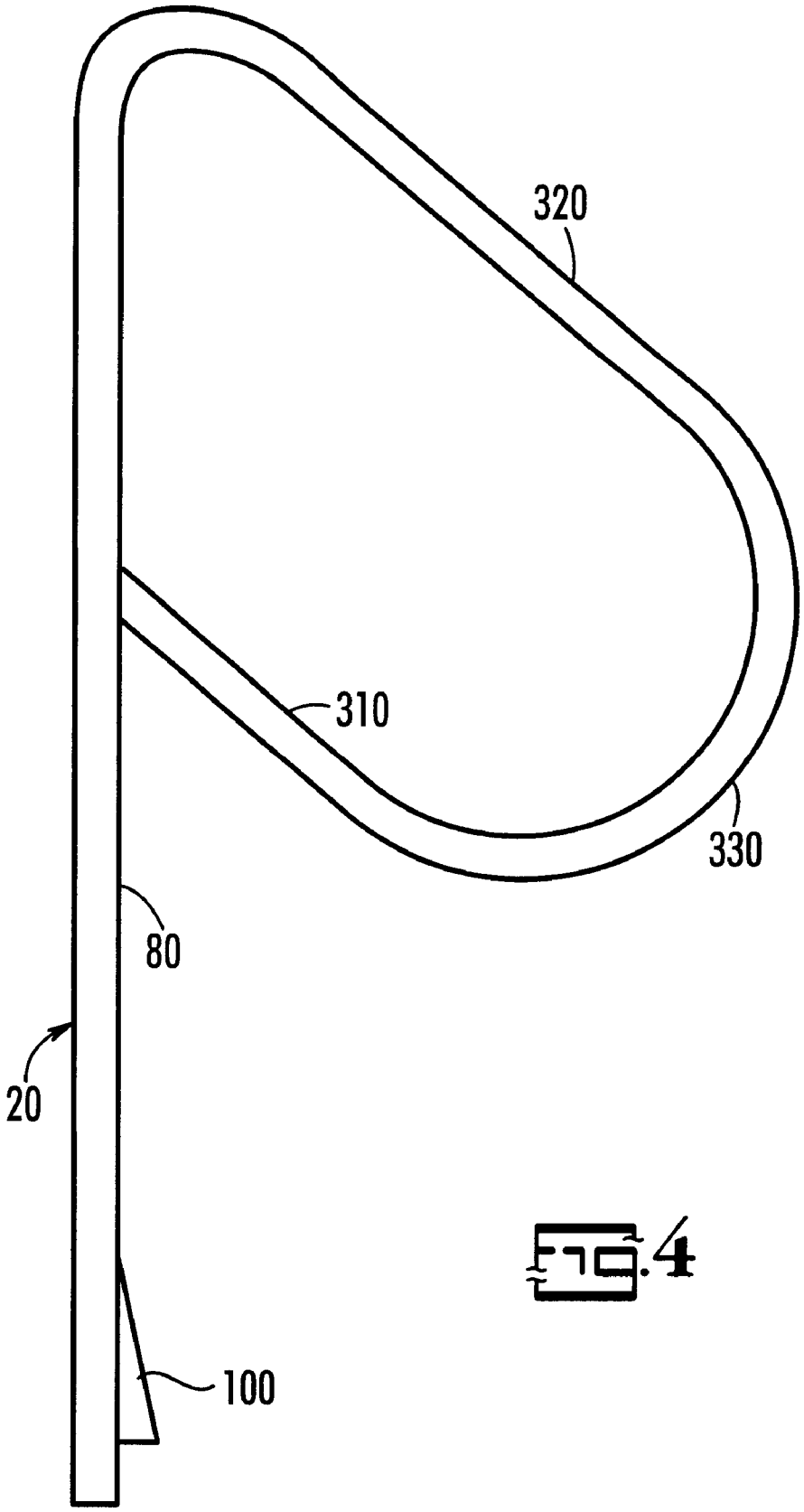
FIG. 4 is a side elevation view of the handle portion of a second embodiment of a P-shaped rail apparatus.

FIG. 4 is a side elevation view of the handle portion 20 of a second embodiment of a P-shaped rail apparatus 10. This second embodiment is similar to the first embodiment as shown in FIG. 3 and previously described and differs by having a lynch peg 100 instead of a pin 60. The lynch peg 100 is a flared element that extends out from the lower portion of the shaft 80 and is also used to secure the rail apparatus 10 in a particular position within the support socket 30.

Figure 5:
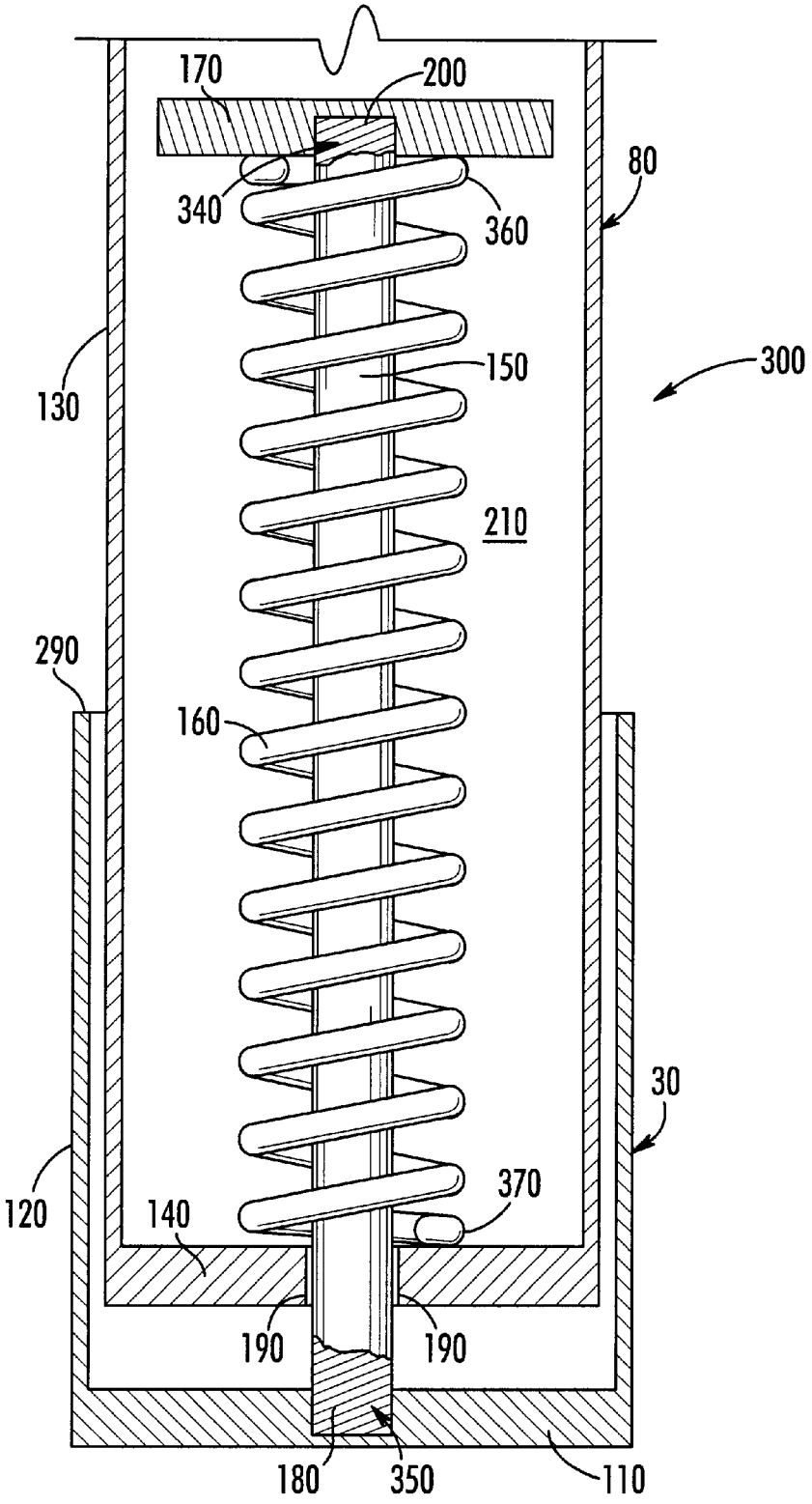
FIG. 5 is a broken-away side elevation view of the mounting mechanism of the rail apparatus.

FIG. 5 is a broken-away side elevation view of the mounting mechanism 300 of the rail apparatus 10. The mounting mechanism 300 is located at the lower end of the shaft 80 and includes a spring 160 used in combination with the support socket 30 to form a secure support.

The shaft 80 of the rail apparatus 10 is hollow in the lower part or completely throughout the entire handle portion 20 forming an inner chamber 210 that is surrounded or defined by a shaft wall 130. The bottom end of the shaft 80, when the rail apparatus 10 is in use, is placed within the support socket 30 in much the same fashion as a pole being placed within a cup.

The support socket 30 is a socket cup 120 having a tubular shape with a socket bottom 110 connected to or integrally formed with a socket sidewall 290. The socket 30 and the shaft 80 are connected together or attached to one another with a connection 180.

The connection 180 in the preferred embodiment is a spring bar 150 on the inside middle portion of the socket bottom 110, but other conventional types of connections may be used. The spring bar 150 is imbedded into the socket bottom 110 and extends up into the inside of the shaft 80 through a shaft bottom aperture 190 in the shaft bottom 140. The shaft bottom aperture 190 allows for the shaft 80 of the rail apparatus 10 to move freely up and down in relation to the spring bar 150.

The spring bar 150 has two ends: an upper or first end 340 and a lower or second end 350 and the spring bar 150 also has a middle portion 380 therebetween the two ends 340, 350. The lower or first end of the spring bar 150 is connected to the socket bottom 110. The lower middle portion extends up through the shaft bottom aperture 190 into the hollow interior of the shaft 80. The upper or second end 350 of the spring bar 150 is attached to a cap 170 with a connection 200. The connection 200 in the preferred embodiment of the invention actually entails the spring bar 150 being imbedded within the cap 170. However, other convention connection means may be used, such as bolting, screwing, welding, gluing or integrally forming the spring bar 150 with the cap 170.

Surrounding the spring bar 150 is a spring 160 which has two ends, and upper or first end 360 and a lower or second end 370 with a middle portion 390 therebetween. The upper or first end 360 of the spring may or may not be connected to the cap 170. The lower or second end 370 of the spring may or may not be connected to the shaft bottom 140. The each end of the spring, 360,370 may simply rest against the adjacent surface.

The mounting mechanism 300 works by keeping the shaft 80 in place within the socket cup 120 by force applied by the spring 160. The spring bar 150 is connected to the socket bottom 110, through the shaft bottom aperture 190 and to the cap 170 that is within the hollow interior of the shaft 80. The spring 160 extends between the cap 170 and the shaft bottom 140. Due to the spring bar 150 extending through the shaft bottom 140 via the shaft bottom aperture 190, the shaft 80 is capable of being moved in an up-and-down direction. When the shaft is moved in an up-and-down direction, the spring 160 is correspondingly compressed and relaxed. When the spring 160 is compressed, the pin 60 or lynch peg 100 are raised above the pin or lynch peg channel 240 allowing for the handle portion 20 to be rotated in any direction. So in order to rotated the handle portion, the shaft 80 is pulled upwardly, causing the spring within to compress, the shaft 80 is rotated to a desired position in which the pin 60 or lynch peg 100 is aligned with a different pin or peg channel 240 that is was recently removed from and then the shaft 80 is lowered so as to place the pin 60 or lynch peg 100 into a different pin or lynch peg channel 240. When the shaft 80 is lowered, the spring 160 is released back to its normal state which may or may not apply a certain amount of pressure on the cap 170 and the shaft bottom 140 which would aid it keeping the shaft 80 in a specific position without rotation.

This ability to rotate the handle portion 20 of the rail apparatus 10 to various positions facilitates the handle portions 20 remaining in their mounted positions on the support surface 50 and does not require their removal when the support surface 50 is in a retracted or closed position.

Figure 6:
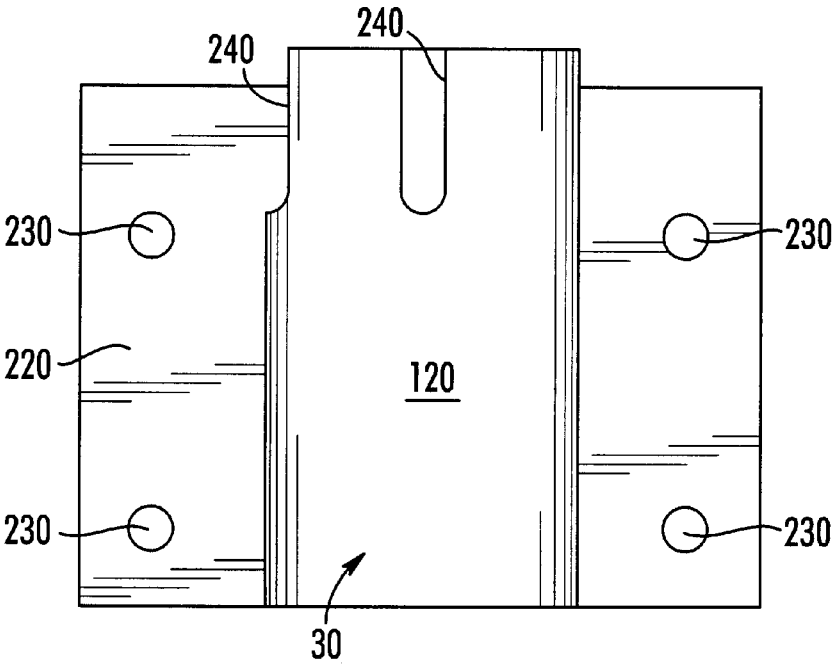
FIG. 6 is a front elevation view of a first embodiment of a support socket.
Figure 7:
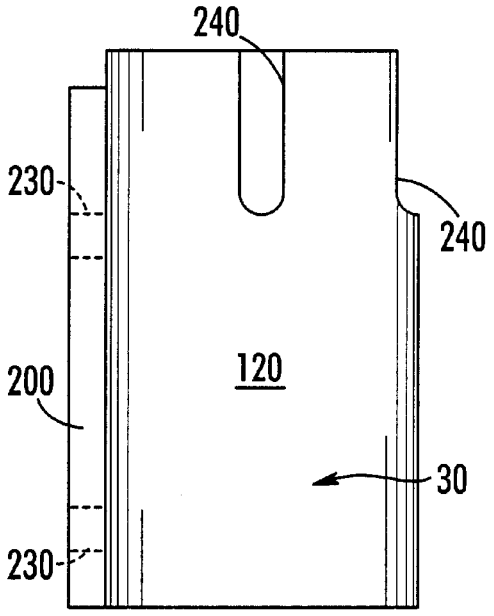
FIG. 7 is a side elevation view of the first embodiment of the support socket.

FIGS. 6 & 7 are elevation views of the support socket 30. FIG. 6 is a front elevation view of a first embodiment of a support socket 30 and FIG. 7 is a side elevation view thereof. The support socket 30 is comprised of a socket cup 120 and a flange 220. The socket cup 120 is attached to one side of the flange 220. The flange 220 is polygonal in shape, preferably rectangular. The socket cup 120 is mounted or attached in the middle of the flange 120 allowing for areas on both sides of flange 220 to extend out beyond the socket cup 120 on either side in a winged fashion.

On each side of the socket cup 120, the flange 220 has a plurality of connection apertures 230. The connection apertures 230 provide a mounting means for the flange 220 to be attached or mounted to a support surface 50 such as bleachers.

The socket cup 120 has a plurality of pin or peg channels 240 located around the perimeter at the upper edge of the socket cup 120. The preferred embodiment, as shown, has one pin or peg channel 240 in the middle front of the socket cup 120 with a second pin or peg channel 240 located on one side of the socket cup 120. The side of the socket cup 120 that the pin or peg channel 240 is located on will dictate the direction in which the handle portion 20 of the rail apparatus 10 can be rotated. However, pin or peg channels 240 can be located on both sides of the socket cup 120 simultaneously or anywhere along the upper perimeter of the socket cup 120 if desired. The pin or peg channel 240 is a slot or cut-out in the socket cup 120 and is used to hold the pin 60 or lynch peg 100, whichever is being used on the rail apparatus 10, in a particular position thus preventing the rail apparatus 10 from rotating in either direction unnecessarily.

Figure 8:
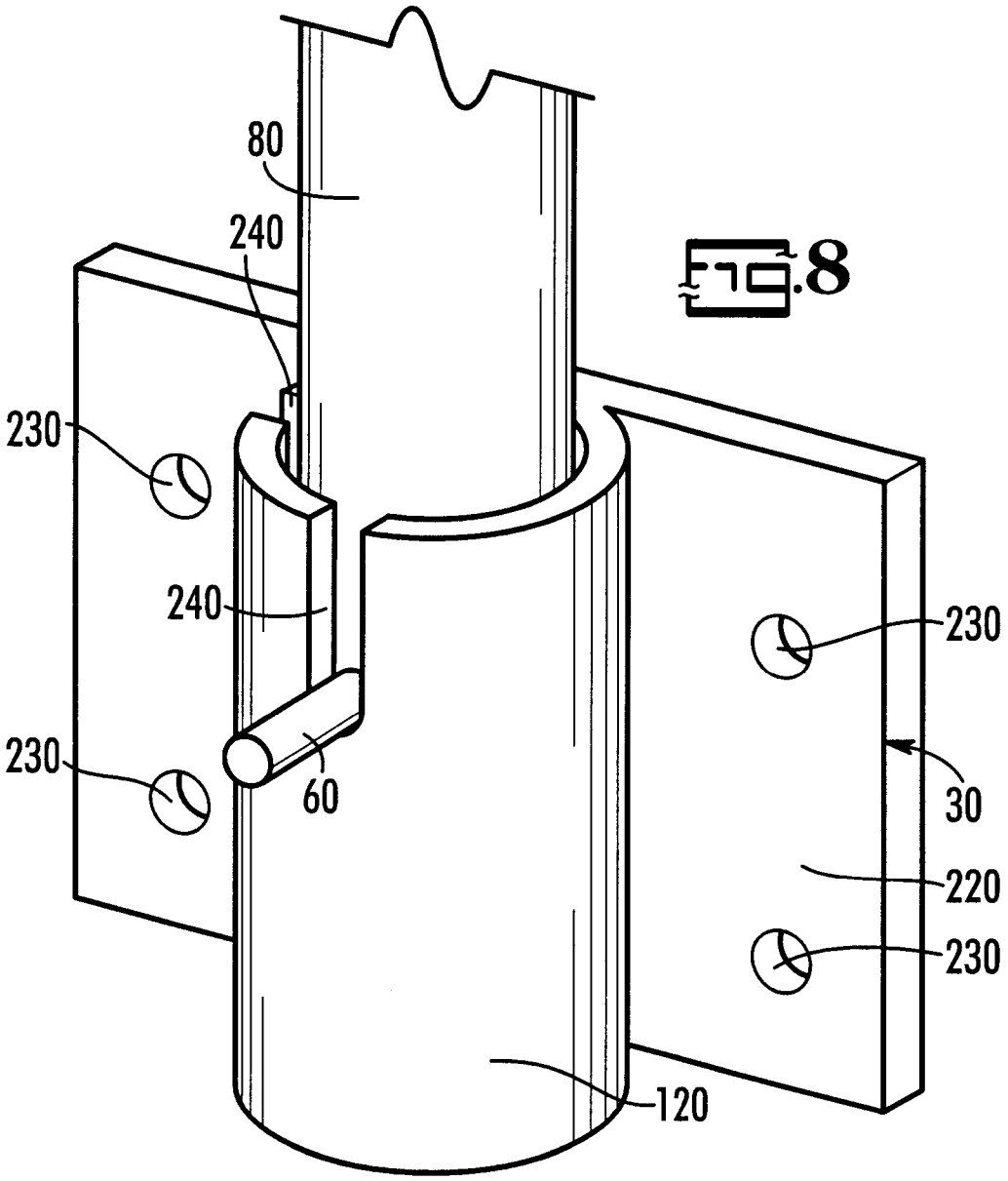
FIG. 8 is a broken-away partial perspective view of a shaft of the rail apparatus within the support socket.

FIG. 8 is a broken-away partial perspective view of the shaft 80 of a rail apparatus 10 within the support socket 30. The lower end of the shaft 80 of the rail apparatus 10 is placed within the socket cup 120 and maintained within by the mounting mechanism 300 previously described in reference to FIG. 5. The pin 60 is slid into place within one of the pin channels 240 to keep the handle portion 20 of the rail apparatus 10 in a specific position. The connection apertures 230 in the flange 220 can be used to attach the support socket 30 to a support surface 50 such as bleachers or stairs. Conventional connecting means such as rivets, screws, nails, bolts, pegs, etc. can be inserted into the connection aperture 230 either from the support structure or into the support structure 50, securing the flange 220 to the support structure 50 and a rear support attachment 430 can be attached from the back side of the support structure 50 to provide additional strength and support to the rail apparatus 10.

This embodiment is to be used on the front or side surfaces of the support structure 50.

Figure 11:
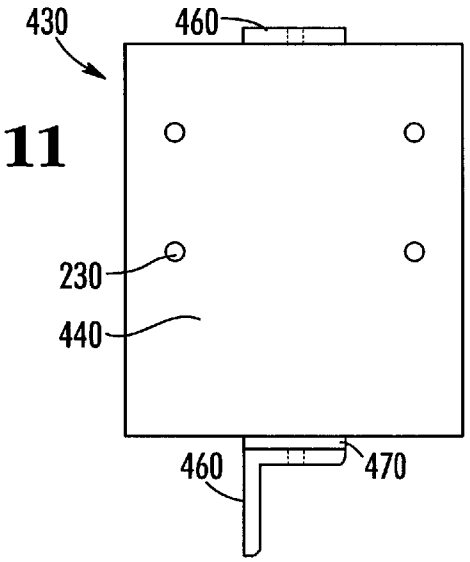
FIG. 11 is a side elevation view of a rear support attachment for the rail apparatus.
Figure 9:
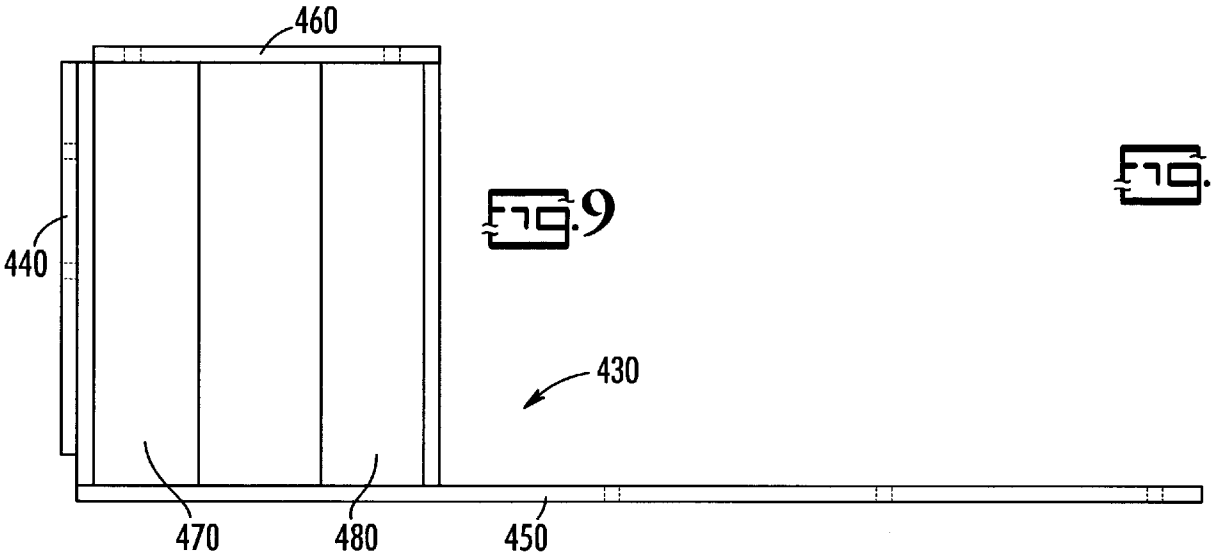
FIG. 9 is a front elevation view of a rear support attachment for the rail apparatus.
Figure 10:
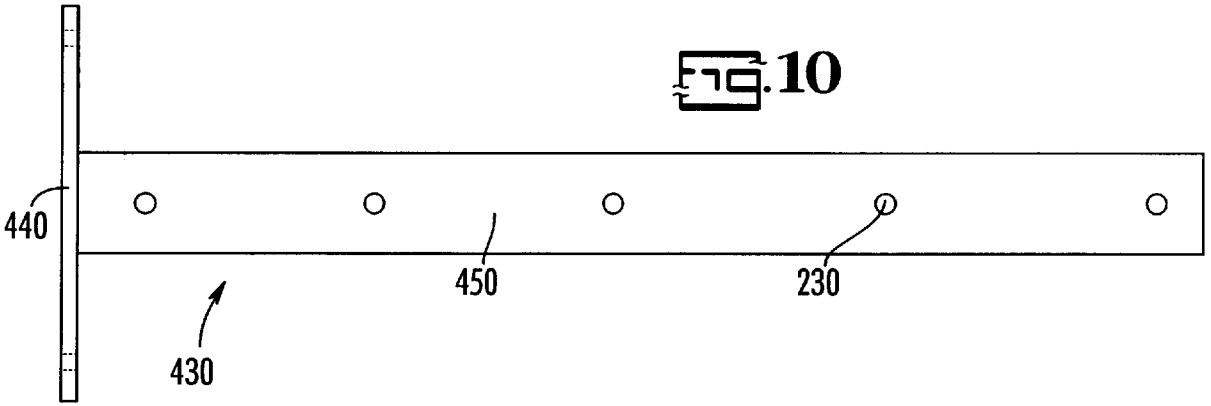
FIG. 10 is a top plan view of a rear support attachment for the rail apparatus.

FIGS. 9, 10 and 11 show the rear support attachment 430 that is used in conjunction with the support socket 30 to provide stability and extra strength to the rail apparatus 10. FIG. 9 is a front elevation view of the rear support attachment 430. FIG. 10 is a top plan view thereof and FIG. 11 is a side elevation view of the rear support attachment 430.

The rear support attachment 430 is used by coupling it with the support socket 30 and having the support structure 50, such as bleachers, positioned in a sandwich fashion therebetween. This layered arrangement adds support to the rail apparatus 10 from within or underneath the support structure 50.

The rear support attachment 430 has a rear attachment plate 440 with connection apertures 230. The orientation and configuration of the connection apertures 230 matches those of the flange 220 of the support socket 30 so as to enable the same connection device (such as screws, bolts, nails, etc.) to be inserted through the flange 220, through the support structure 50 and through the rear attachment plate 440.

The rear attachment plate 440 is connected to a first cross arm 470. Parallel to the rear attachment plate 440 and first cross arm 470 is a second cross arm 480. The second cross arm 480 is connected to the first cross arm 470 with a first or short support arm 460 on one end and a second or long support arm 450 on the opposite end. The first cross arm 470, second cross arm 480, short support arm 460 and the long support arm 450 are connected together forming a box shape with the long support arm 450 extending perpendicular to the rear attachment plate 440.

The long support arm 450 has a plurality of connection apertures 230 periodically spaced along the entire length of the long support arm 450. The connection apertures 230 are used to connect the rear support attachment 430 to the underneath side of the support structure 50 adding to the overall stability and strength of the rail apparatus 10.

FIGS. 12, 13 & 14 are elevation views of a second embodiment of a support socket 30. FIG. 12 is a front elevation view of a second embodiment of the support socket 30 and FIG. 13 is a side elevation view thereof. FIG. 14 is a side elevation view of a rear plate 420 that is to be placed behind the support surface 50 so the connection apertures 230 are in alignment with the connection apertures 230 of the horizontal section 400 of the flange 220 of the support socket 30. When both the horizontal section 400 and the rear plate 420 of this second embodiment of the support socket 30 are in place, they are on both the front and top sides of the support structure 50, adding stability to the support socket 30. This embodiment is similar to the first embodiment with regard to the details of the support socket 30 being comprised of a flange 220 and a socket cup 120 with a plurality of pin or peg channels 240, it differs by the flange 220 being somewhat "L-shaped" instead of merely a flat plate.

The primary difference between the first embodiment and this second embodiment is found in the configuration of the flange 220. The flange 220 in the second embodiment is angled to allow the support socket 30 to be attached to the horizontal, top or flat surface of a support surface 50 while at the same time being attached to a vertical, front or side surface.

The flange 220 in this embodiment has two sections: a top or horizontal section 400 and a front or vertical section 410.

The horizontal section 400 extends out perpendicular, or at any desired angle, to the socket cup 120 and has a plurality of connection apertures 230. This horizontal section 400 can be placed on and connected to a horizontal support surface such as the run of a set of stairs or the seat portion of bleachers.

The vertical section 410 is parallel, adjacent and connected to the socket cup 120. The vertical section 410 also has a plurality of connection apertures for connecting the flange 220 to a vertical support surface.

The two-section configuration allows for the support socket 30 to be connected to two separate surfaces on the support surface 50 simultaneously. This two-section connection provides a secure support by allowing the force from the rail apparatus 10 to be distributed to two separate surfaces instead of just one.

As with the first embodiment, the lower end of the shaft 80 is located within the socket cup 120 having its pin 60 or lynch peg 100 inserted into one of the plurality of pin or peg channels 240 to prevent the shaft 80 from unnecessary rotation.

Figure 17:
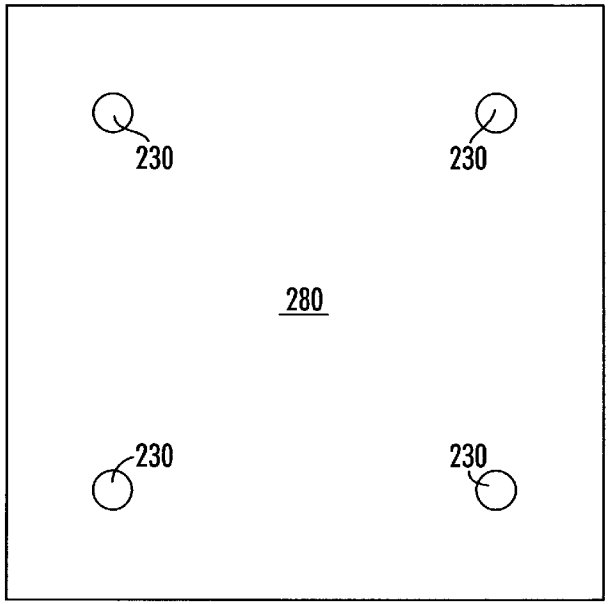
FIG. 17 is a top plan view of a support plate.
Figure 15:
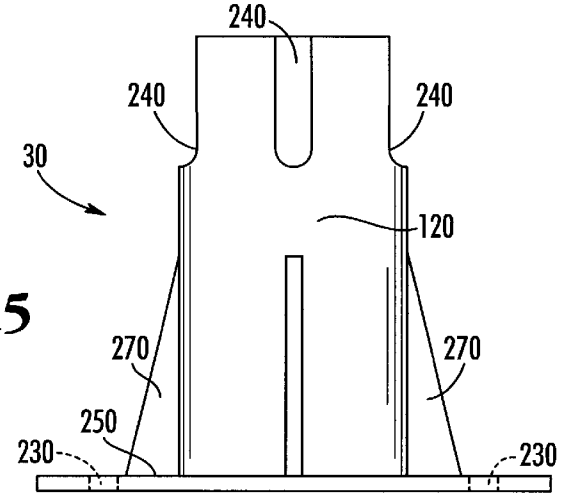
FIG. 15 is a side elevation view of a third embodiment of the support socket.
Figure 16:
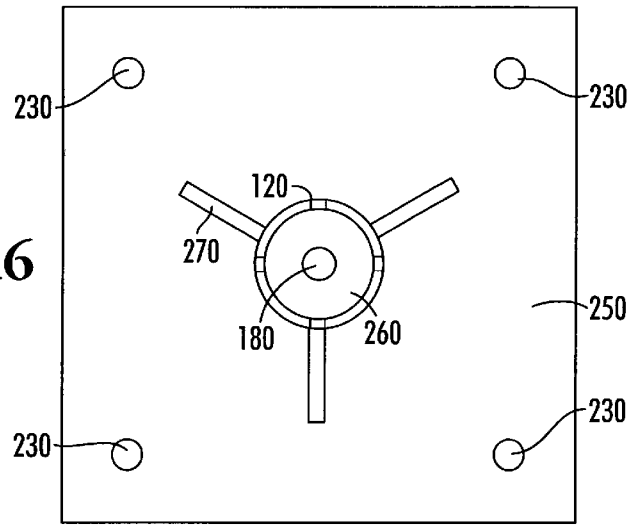
FIG. 16 is a top plan view of the third embodiment of the support socket.

FIGS. 15, 16 and 17 disclose a third embodiment of a support socket 30. FIG. 15 is a side elevation view and FIG. 16 is a top plan view of the support socket 30. FIG. 17 is a top plan view of an additional support plate 280 that is used in conjunction with the bottom plate 250 to provide a more stable, secure support for the support socket 30.

The support socket 30 has a socket cup 120 that is connected to a bottom plate 250 at the socket bottom 110 or is integrally formed therewith. In the preferred embodiment, the socket cup 120 is configured to extend or protrudes up from the bottom plate 250 perpendicularly, but other angles are foreseeable alternatives. This embodiment is used by placing the bottom plate 250 on a horizontal surface so the socket cup 120 is standing in a vertical position with respect to the horizontal position of the bottom plate 250.

The socket cup 120 is flanked by a plurality of gussets 270 equidistantly spaced around the lower perimeter of the socket cup 120 where the socket cup 120 is connected to the bottom plate 250. Three gussets 270 are shown in FIGS. 15 and 16, however any number of gussets 270 may be used depending upon necessity, desired support or mere designer's choice.

The gussets 270 provide support to the socket cup 120 when the support socket 30 is in use with a handle portion 20 inserted therein. As with previous embodiments, the lower end of the shaft 80 of the handle portion 20 is inserted and held within the support socket 120 with the mounting mechanism 300 as described in detail with regard to FIG. 5. The support cup has a plurality of pin or peg channels 240 surrounding the upper perimeter of the support cup 120 and are used to hold or cradle the pin 60 or lynch peg 100 when the handle portion 20 is in place within the support cup 120.

The connection 180 for the spring bar 150 is shown within hollow center 260 of the support cup 120. When in use, this connection 180 would not be visible due to the shaft 80 of the handle portion 20 being connected to the support cup 120.

The bottom plate 250 has a plurality of connection apertures 230 for connecting the support socket 30 to a support structure 50. The number and configuration of connection apertures can vary depending upon need and desire.

A support plate 280 having a plurality of connection apertures 230 is used in conjunction with the bottom plate 250 in order to add extra support for various surfaces. The connection apertures 230 in the support plate 280 should be arranged so they align with the connection apertures 230 of the bottom plate 250. For example, if the support socket 30 is to be used with a concrete surface, the bottom plate 250 may be small enough in size and shape to easily concentrate all its associated forces to a small, concentrated area on the concrete support surface and weaken the strength of the concrete support surface. By placing a support plate 280 between the concrete support surface and the bottom plate 250, the forces are distributed over a large area, adding to the stability of the support socket 30 while diminishing potential for damage to the concrete surface due to the concentrated forces being applied.

The rail apparatus described herein and illustrated in the drawings is subject to other advantages and modifications that may be apparent to those of ordinary skill in the art without departing from the spirit and scope of the appended claims. Accordingly, the invention is to be limited only by the scope of the following claims and their equivalents.

What is claimed is:

1. A rail apparatus for attachment to a support structure comprising:

a handle portion;

a shaft having a hollow interior and a bottom attached to said handle portion;

a support socket having at least one channel, and a socket cup for receiving a lower end of said shaft; and a pin extending from said shaft;

said pin being placed within said at least one channel to prevent said handle portion from unnecessary rotation.

2. The rail apparatus of claim 1 further comprising a mounting mechanism with a spring bar connected to a bottom of said socket cup at one end and connected to a cap at the opposite end;

said cap being within said hollow interior of said shaft;

a spring being connected to said spring bar between said bottom of said socket cup and said cup within said hollow interior of said shaft;

wherein said spring provides a force on said bottom of said shaft keeping said shaft secured within said support socket yet allowing for said handle portion to be lifted, rotated and released to a position with the pin secured within one of said at least one channel.

3. The rail apparatus of claim 2, further comprising:

a rear support attachment with a rear attachment plate having a plurality of connection apertures, said connection apertures arranged the same orientation as said connection apertures on said flange enabling said rear support attachment to be connected with said support socket and said rear attachment plate.

4. The rail apparatus of claim 3, wherein:

said rear support attachment further comprises a first cross arm, a second cross arm, a first support arm, and a second support arm;

wherein said first cross arm, said second cross arm, said first support arm and said second support arm form a box shape and said second support arm is capable of being attached to said support structure for added support.

5. A rail apparatus for attachment to a support structure comprising:

a handle portion;

a shaft having a hollow interior and a bottom;

a support socket having at least one channel and a socket cup for receiving said shaft; and a lynch peg extending form said shaft;

wherein said pin being placed within said at least one channel to prevent said handle portion from unnecessary rotation.

6. The rail apparatus of claim 5, further comprising:

a mounting mechanism having a spring bar connected to a bottom of said socket cup at one end and connected to a cap at the opposite end;

said cap being within said hollow interior of said shaft;

a spring being connected to said spring bar between said bottom of said socket cup and said cap within said hollow interior of said shaft;

wherein said spring provides a force on said bottom of said shaft keeping said shaft secured within said support socket yet allowing for said handle portion to be lifted, rotated and released to a position with the lynch peg secured within one of said at least one channel.

7. The rail apparatus of claim 6, further comprising:

a rear support attachment with a rear attachment plate having a plurality of connection apertures, said connection apertures arranged in the same orientation as said connection apertures on said flange enabling said rear support attachment to be connected with said support socket and said rear attachment plate.

8. The rail apparatus of claim 7, wherein:

said rear support attachment further comprises a first cross arm, a second cross arm, a first support arm, and a second support arm;

wherein said first cross arm, said second cross arm, said first support arm and said second support arm form a box shape and said second support arm is capable of being attached to said support structure for added support.

9. A rail apparatus for attachment to a support structure comprising:

a handle portion having a shaft;

a support socket having at least one channel, said support socket being connected to said shaft;

a pin extending from said shaft;

a mounting mechanism having a spring;

said shaft having a hollow interior and a bottom;

said support socket having a socket cup comprised of a bottom and a sidewall, said socket cup for receiving a lower end of said shaft; and said support socket having a bottom plate with a plurality of connection apertures, said bottom plate being connected to said bottom of said socket cup and having a plurality of gussets attached to said sidewall of said socket cup and said bottom plate;

wherein said pin is placed within said channel to prevent said handle portion from unnecessary rotation.

10. The rail apparatus of claim 9, wherein:

said mounting mechanism has a spring bar connected to said bottom of said socket cup at one end and connected to a cap at the opposite end;

said cap being within said hollow interior of said shaft;

said spring being connected to said spring bar between said bottom of said socket cup and said cap within said hollow interior of said shaft;

wherein said spring provides a force on said bottom of said shaft keeping said shaft secured within said support socket yet allowing for said handle portion to be lifted, rotated and released to a position with the pin secured within one of at least one channel.

11. The rail apparatus of claim 10, further comprising:

a support plate having a plurality of connection apertures, said connection apertures arranged in the same orientation as said connection apertures on said bottom plate enabling support socket said socket to be connected to said support plate.

* * * * *